US006463589B1

(12) United States Patent
Wang

(10) Patent No.: US 6,463,589 B1
(45) Date of Patent: Oct. 15, 2002

(54) SMOKE-PROOF HEADGEAR

(76) Inventor: Chung-Ying Wang, 6F, No. 83, Roosevelt Road, Section 6, Taipei (TW)

( * ) Notice: Subject to any disclaimer, the term of this patent is extended or adjusted under 35 U.S.C. 154(b) by 0 days.

(21) Appl. No.: 10/027,536

(22) Filed: Dec. 20, 2001

(51) Int. Cl.[7] ..... A42B 1/00
(52) U.S. Cl. ..... 2/7; 128/201.15
(58) Field of Search ..... 2/7, 8, 9, 172, 2/174, 202, 206, 410, 68, 456, 458, 5, 6.1, 6.3, 84, 171, 81, 171.4, 173, 901, 918, 424, DIG. 1; 55/DIG. 33, DIG. 35; 128/201.15, 200.27, 200.28, 201.12, 206.16, 206.21, 201.25

(56) References Cited

U.S. PATENT DOCUMENTS 1,800,051 A * 4/1931 Blanco ..... 128/201.25
2,296,338 A * 9/1942 Dakin ..... 128/201.15
3,789,839 A * 2/1974 Lund et al. ..... 128/201.25
4,411,023 A * 10/1983 Pinson ..... 128/201.26
5,293,864 A * 3/1994 McFadden ..... 128/201.29
5,452,712 A * 9/1995 Richardson ..... 128/201.22
6,134,716 A * 10/2000 Richardson ..... 2/171.2

* cited by examiner

*Primary Examiner*—Gloria M. Hale
*Assistant Examiner*—Tejash Patel
(74) *Attorney, Agent, or Firm*—Pro-Techtor International Services

(57) ABSTRACT

A smoke-proof headgear has a headgear body. The headgear body is made of aluminumized oxide fiber cloth. A window is seamed to a predetermined position through a connecting fire-proof wire. The lower side of the window has a filtering piece of a gauze mask and a neck tighter is placed at the inner side of the headgear body. All the components are made of heat-tolerable materials. In use, the user wears the headgear at first; and the filtering piece is used to mask the mouth and nose. A press-able switch adjusts the spanner band to a correct position for preventing smoke from entering into the body so as to protect the head, eyes. and breathing system of the user from being harmed. Moreover, the user breaths through the breathing tube so as not to feel hot and the user may clearly see the situation of the scene of a fire.

5 Claims, 4 Drawing Sheets

SMOKE-PROOF HEADGEAR

BACKGROUND OF THE INVENTION

1. Field of the Invention

The present invention relates to a smoke-proof headgear. and particularly to a smoke-proof headgear in which the tightness thereof is adjustable and a breathing tube is used to prevent wasted gas or smoke from flowing into the body. Thus, the user can run away from the scene of a fire easily.

2. Description of the Related Art

In current modern society, there are many super high buildings in the cities. If fire accidents occur, it is often that many peoples can not run away from the scene of a fire successfully. Moreover, in many well decorated places, such as KTV, MTV stores. restaurants, etc., if air can not be well evacuated, the materials for decorations easily catch fire so that the fire spreads widely. Statistically, in a fire accident, a large part of people is choked to die due to breath particles into the lungs. Therefore, it is important to prevent smoke into lung. In general, headgear is used to cover the heads of the user for preventing the user from breathing smoke.

FIG. 1 shows a prior smoke-proof headgear. The headgear mainly comprises a headgear body 10, a window 11. a filtering piece 12 of a gauze mask, a flannelet 13, and an elastic neck tighter 14. The window 11 is seamed to a predetermined position of the headgear body 10. The left and right sides and the lower sides are seamed to the inner side of the headgear body 10. A plurality of round holes 101 are formed on the headgear body 10. The filtering piece 12 is placed between the headgear body 10 and the filtering piece 12. The elastic neck tighter is seamed to a predetermined position at a lower side of the headgear body 10. As fire accident occurs, the headgear is used to enclose the head of the user. Since the elastic neck tighter 14 of the prior smoke-proof headgear tightly encloses the neck, the user will feel uneasy. Furthermore, the air breathed from the user can not be drained out successfully so that the user will feel hot. Moreover, since the air contains vapor, it is easy condensed on the window 11 and on the glasses of the user if user wears a pair of glasses. As a result, the user can not see the situation of the scene of a fire and thus he (or she) can not find a right way to run away.

The various objects and advantages of the present invention will be more readily understood from the following detailed description when read in conjunction with the appended drawing.

SUMMARY OF THE INVENTION

Accordingly, the primary object of the present invention is to provide a smoke-proof headgear, where a press-able switch is used to adjust the tightness of a band for preventing smoke from entering into the headgear so as to avoid an uneasy feeling.

To achieve above objects, the present invention provides smoke-proof headgear, wherein the user breaths through the breathing tube so as not to feel hot and the user may clearly see the situation of the scene of a fire.

A smoke-proof headgear comprise: a headgear body; a window seamed to a predetermined position through a connecting fire-proof wire; a flannelet having two sides and lower ends of which being seamed to an inner side of the connecting fire-proof wire; a sticky strip placed on a predetermined position on an inner side of the headgear body and stuck to an upper end of the flannelet; a plurality of round holes formed on the flannelet, which are corresponding to the plurality of round holes on the headgear body of the flannelet; a filtering piece of a gauze mask installed between the headgear body and the flannelet; a light reflecting fiber strip seamed to a predetermined position below the headgear body through a connecting fire-proof wire; a neck tighter made of oxidized fiber cloth; the neck tighter seamed to a predetermined position at a lower inner side of the headgear body; a spanner band being seamed to a lower side of the neck tighter; a press-able switch being installed on the spanner band for adjusting the tightness of the band; an air tube seamed to a predetermined position at an inner lower side of the headgear body by a connecting fire-proof wire for breathing; a check valve being front at a front end of the breathing tube for preventing wasted air from flowing into the tube; and a connecting fire-proof wire for seaming the window, flannelet, light reflecting strip, neck tighter, and breathing tube to the headgear body.

DETAILED DESCRIPTION OF THE INVENTION

Figure 1:
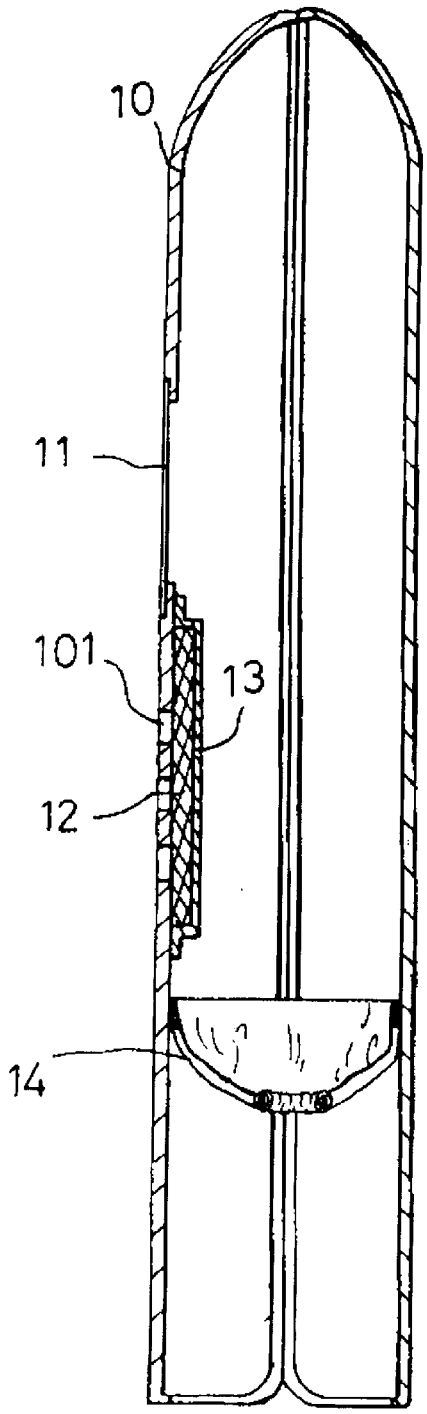
PRIOR ART Fig.1
FIG. 1 is a cross sectional view of a prior smoke-proof headgear.
Figure 2:
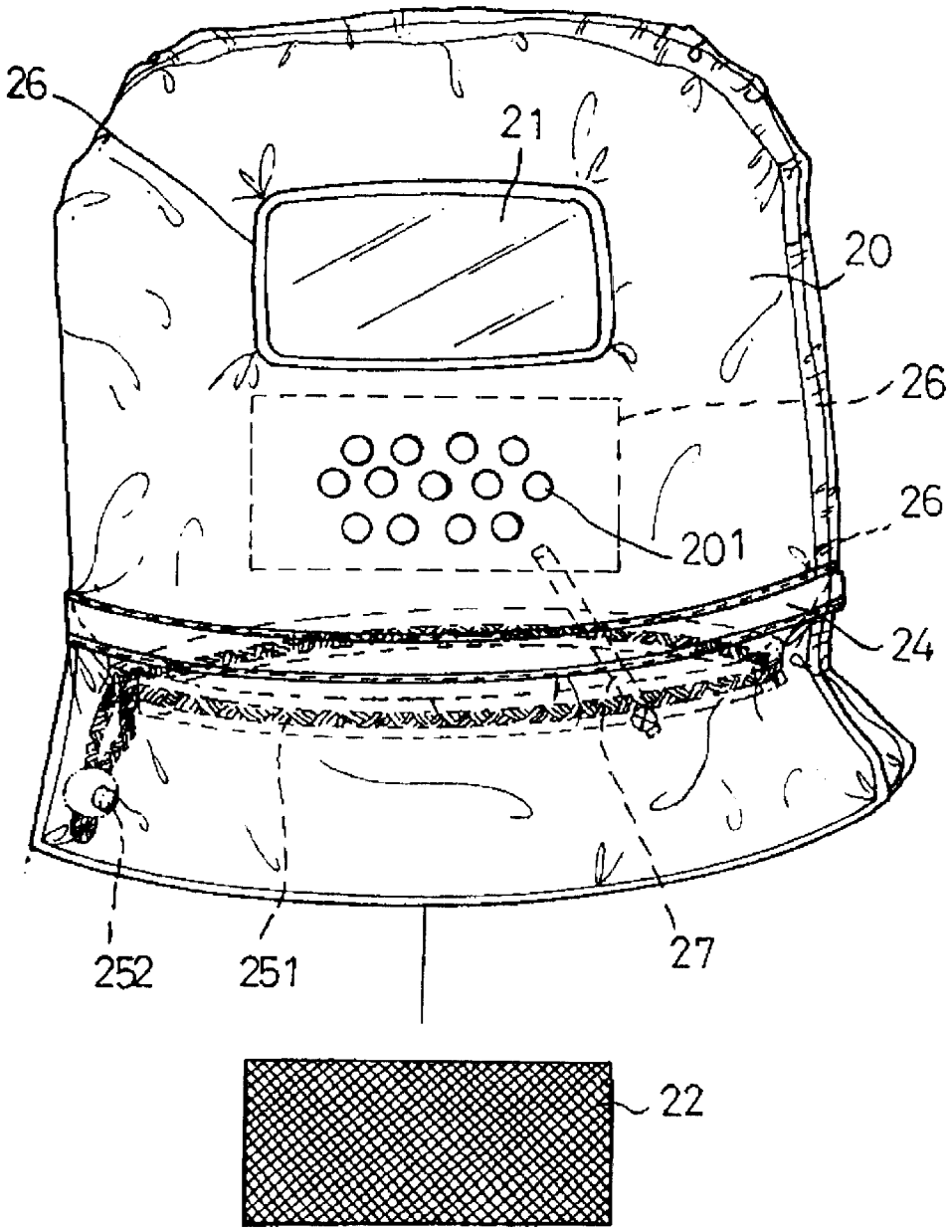
FIG. 2 is a front exploded view of the present invention.
Figure 3:
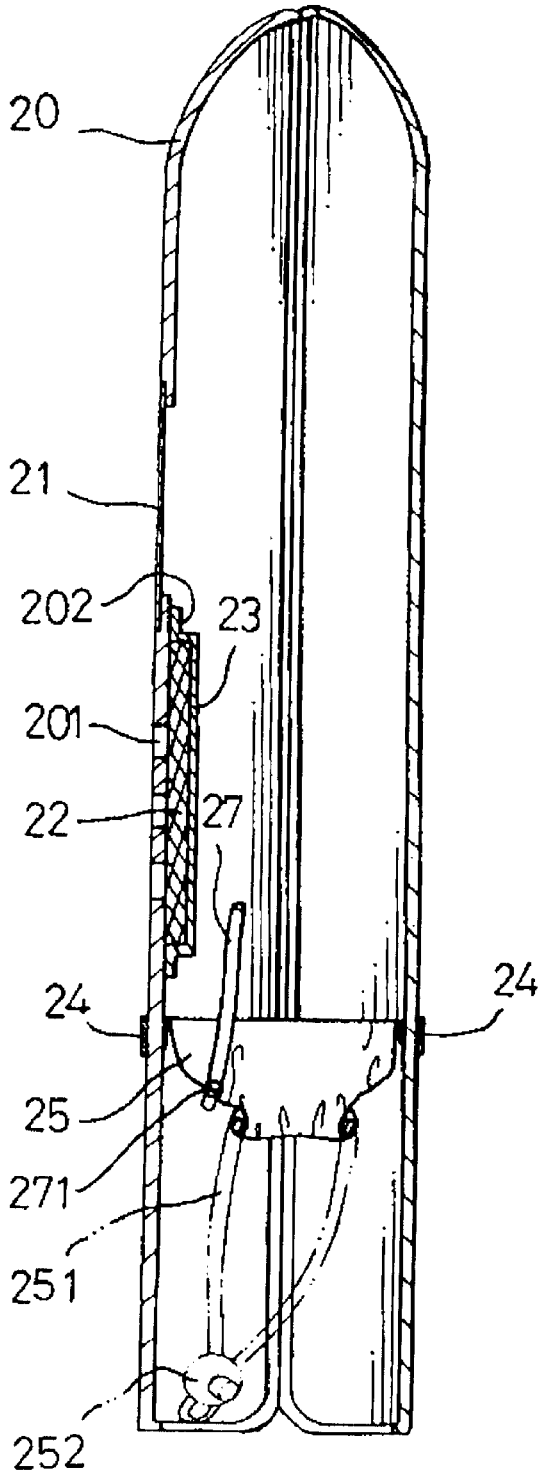
FIG. 3 is a cross sectional view of the present invention.

Referring to FIGS. 2 and 3, the front exploded view and cross sectional view of the present invention are illustrated. It is appreciated that the present invention is formed by three parts: a headgear body 20 which is made of aluminumized oxidized fiber cloth processed; a window 21 seamed to a predetermined position through a connecting fire-proof wire and made of PET material; a flannelet 23 two sides and lower ends of which being seamed to an inner side of the connecting fire-proof wire 26; a sticky strip 202 placed on a predetermined position on the inner side of the headgear body 20 and stuck to an upper end of the flannelet 23; a plurality of round holes formed on the flannelet 23. which are corresponding to the plurality of round holes 201 on the headgear body 20 of the flannelet 23; a filtering piece 22 of a gauze mask installed between the headgear body 20 and the flannelet 23; a light reflecting fiber strip 24 seamed to a predetermined position below the headgear body 20 through a connecting fire-proof wire 26; a neck tighter 25 made of oxidized fiber cloth; the neck tighter seamed to a predetermined position at a lower inner side of the headgear body 20; a spanner band 251 being seamed to a lower side of the neck tighter; a press-able switch 252 being installed on the spanner band 251 for adjusting the tightness of the band 251; an air tube 27 seamed to a predetermined position at an inner lower side of the headgear body 20 by a connecting fire-proof wire 26 for breathing; a check valve being front at a front end of the breathing tube 27 for preventing wasted air from flowing into the tube, and a connecting fire-proof wire 26 formed by fire-proof yarns for seaming the window 21, flannelet 23, light reflecting strip 24, neck tighter 25, and breathing tube 27 to the headgear body 20.

Figure 4:
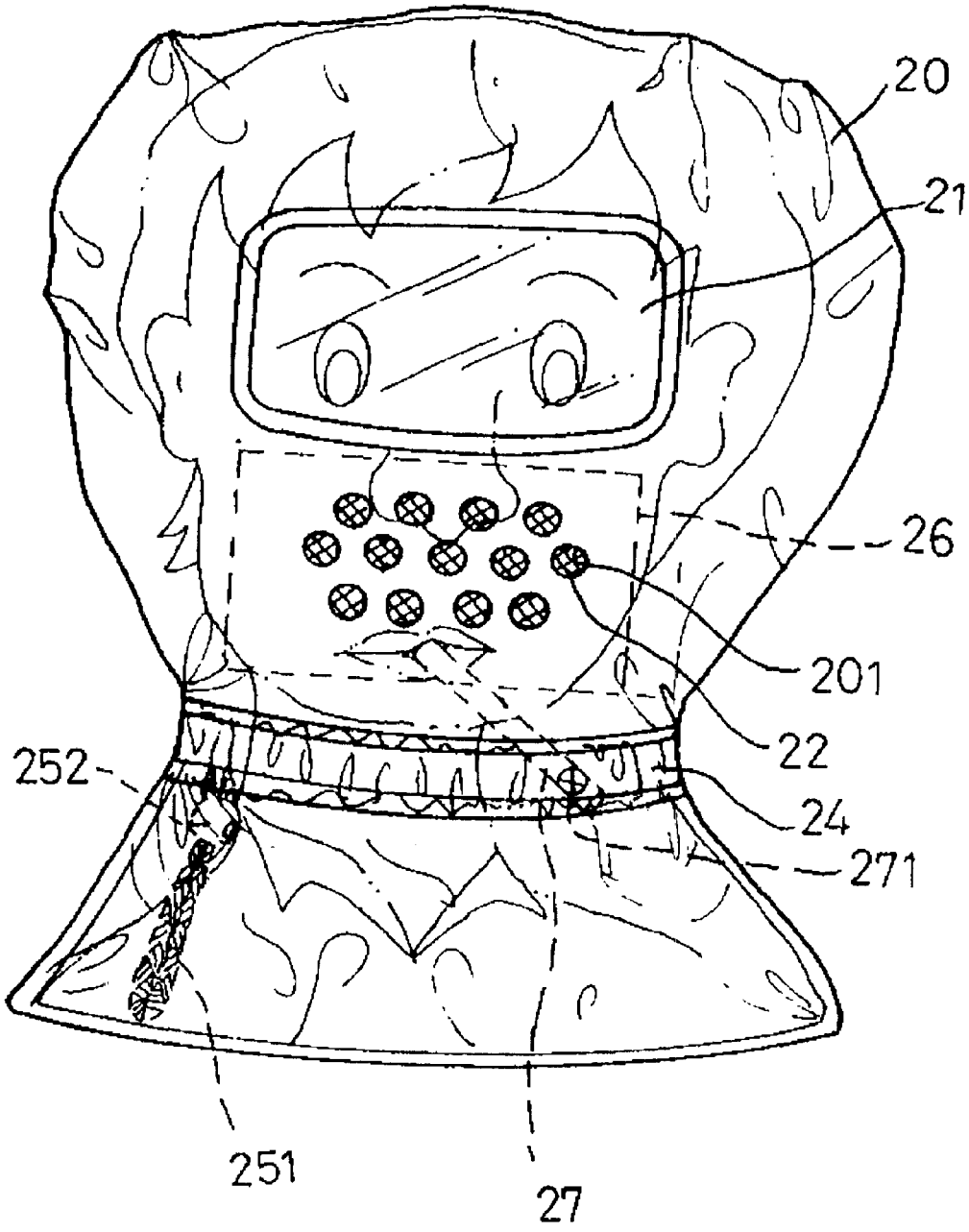
FIG. 4 shows an application of the present invention.

An application of the present invention is illustrated in FIG. 4. In use, the user wears the headgear at first; the filtering piece 22 is used to mask the mouth and nose of the user; the press-able switch 252 adjusting the spanner band 251 to a correct position for preventing smoke from entering into the body of the user so as to protect the head, eyes, and breathing system of the user from being harmed by smoke. Moreover, the user breaths through the breathing tube 27 so as not to feel hot and the user may clearly see in the scenery of the fire accident. A front end of the breathing tube 27 has a check valve 271 for preventing the user from breathing waste gas. After the present invention is used, the upper end of the flannelet 23 is separated from the sticky strip 202 of the headgear body 20, and then the filtering piece 22 of the gauze mask is taken out for placing a new one. Then an upper end of the flannelet 23 is sticky strip 202 of the headgear body 20.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A smoke-proof headgear comprise:

a headgear body;

a window seamed at a predetermined position of the headgear body through a connecting fire-proof wire;

a flannelet having two sides and a lower end which are seamed to an inner side of the connecting fire-proof wire;

a sticky strip placed on a predetermined position on an inner side of the headgear body and stuck to an upper end of the flannelet; a plurality of round holes formed on the flannelet, which are corresponding to the plurality of round holes on the headgear body of the flannelet;

a filtering piece of a gauze mask installed between the headgear body and the flannelet;

a light reflecting fiber strip seamed to a predetermined position below the headgear body through a connecting fire-proof wire;

a neck tighter made of oxidized fiber cloth; the neck tighter seamed to a predetermined position at a lower inner side of the headgear body; a spanner band being seamed to a lower side of the neck tighter; and a press-able switch being installed on the spanner band for adjusting the tightness of the band;

an air tube seamed to a predetermined position at an inner lower side of the headgear body by a connecting fire-proof wire for breathing, and a check valve being front at a front end of the breathing tube for preventing wasted air from flowing into the tube; and a connecting fire-proof wire for seaming the window, flannelet, light reflecting strip, neck tighter and breathing tube to the headgear body.

2. The smoke-proof headgear as claimed in claim 1, wherein the headgear body is made of aluminumized oxide fiber cloth.

3. The smoke-proof headgear as claimed in claim 1, wherein the window is made of PET material.

4. The smoke-proof headgear as claimed in claim 1, wherein the neck tighter is made of oxidized fiber cloth.

5. The smoke-proof headgear as claimed in claim 1, wherein the connecting fire-proof wire is made by seaming fire-proof yarn.

* * * * *